US006131320A

United States Patent [19]

Eberle et al.

[11] Patent Number: 6,131,320

[45] Date of Patent: Oct. 17, 2000

[54] FLOOR SIGN

[75] Inventors: John David Eberle, Amherst; Daniel Joseph D'Arcy, Lancaster; Donald Lawrence Davis, East Aurora, all of N.Y.

[73] Assignee: American Allsafe Company, Tonawanda, N.Y.

[21] Appl. No.: 08/949,914

[22] Filed: Oct. 14, 1997

[51] Int. Cl.[7] ..... G09F 15/00

[52] U.S. Cl. ..... 40/610; 40/606

[58] Field of Search ..... 40/606, 610; 16/265, 16/266, 268, 381, 225, 224, 254, 260, 271; 248/166, 127

[56] References Cited

U.S. PATENT DOCUMENTS

| | | | |
|---|---|---|---|
| D. 371,807 | 7/1996 | Mandell et al. | D20/10 |
| 2,963,734 | 12/1960 | Huget | 16/381 X |
| 3,057,591 | 10/1962 | Weimer | 248/166 |
| 3,077,282 | 2/1963 | Eggers | 16/224 X |
| 3,295,713 | 1/1967 | Optner | 16/265 X |
| 4,005,537 | 2/1977 | Von Camber et al. | 40/610 |
| 4,253,260 | 3/1981 | Maza et al. | 40/610 |
| 4,298,186 | 11/1981 | Glass | 256/64 |
| 4,765,674 | 8/1988 | Svensson | 16/224 X |
| 4,796,369 | 1/1989 | Hamann | 40/606 |
| 4,859,983 | 8/1989 | Kulp et al. . | |
| 4,928,415 | 5/1990 | Walters | 40/610 |
| 4,974,815 | 12/1990 | Glass | 256/64 |
| 4,977,697 | 12/1990 | Genick | 40/606 |
| 4,999,937 | 3/1991 | Bechtold | 40/610 |
| 5,003,912 | 4/1991 | Thurston | 116/63 P |
| 5,009,541 | 4/1991 | Thurston | 404/6 |
| 5,046,885 | 9/1991 | Thurston | 404/10 |
| 5,382,112 | 1/1995 | Fu | 40/610 X |
| 5,458,434 | 10/1995 | Bent et al. | 404/6 |
| 5,621,992 | 4/1997 | Mandell et al. | 40/610 |

*Primary Examiner*—Terry Lee Melius
*Assistant Examiner*—James M Hewitt
*Attorney, Agent, or Firm*—Howell & Haferkamp, L.C.

[57] ABSTRACT

Each display panel of a free-standing, foldable floor sign includes an integrally formed handle portion and male and female hinge projections. The male and female hinge projections snap together into interlocking engagement with each other in response to simultaneous axial compression. The male coupling member includes a resilient finger portion and a latching head, and the female coupling member includes a cylindrical collar having a latch pocket and a radially stepped, inwardly projecting retainer. The resilient finger portion is radially deflectable in response to sliding engagement of the latching head against the retainer to permit the latching head to clear the retainer and enter the latch pocket. The display panels are stabilized in a spread-apart service position by a locking arm that is pivotally coupled to the display panels for folding movement within longitudinal slots formed along side edges of the display panels. Two or more floor signs are linked together by chains to provide a wide area barrier to entry.

20 Claims, 6 Drawing Sheets

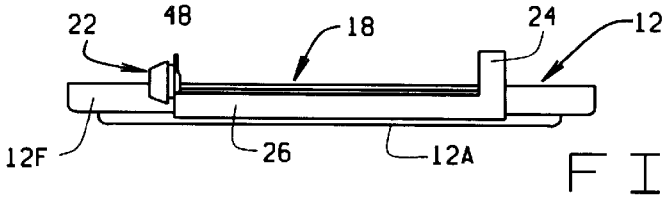
FIG. 9
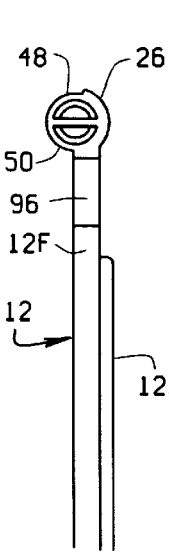
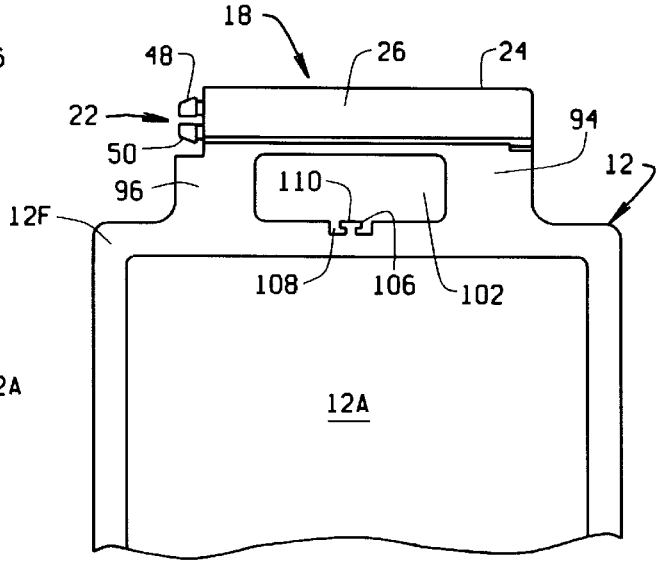
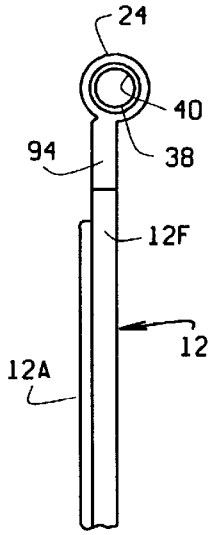
FIG. 7
FIG. 8
FIG. 6
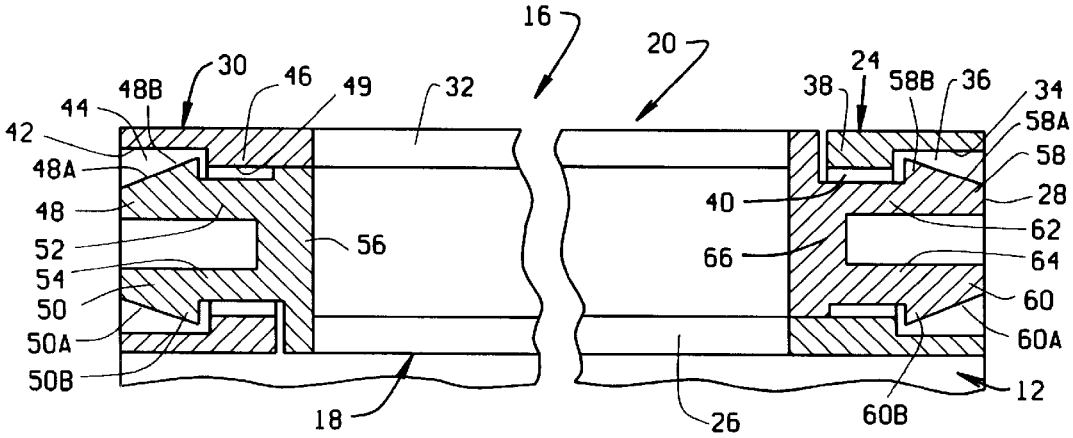
FIG. 10

FLOOR SIGN

BACKGROUND OF THE INVENTION

This invention relates generally to free-standing floor signs of the type used for displaying warning messages and serving as a temporary barrier to foot traffic.

Conventional warning/cautionary floor signs include display panels that are hinged together for unfolding movement to an upright service position in which the panels are spread apart in a free-standing A-frame arrangement and for folding movement to a minimum profile flat configuration for storage. Such floor signs are typically of molded plastic construction and include warning messages, designs or figures that alert building occupants with respect to an unsafe condition, for example a wet floor or maintenance/repair activity. Two or more free-standing floor signs can be linked together by chains or ropes to provide a temporary barrier to entry onto an unsafe floor surface or into an area where maintenance or repairs are being performed. Because such floor signs signal the existence of an unsafe condition, they should be easy to set up for stable, free-standing service when an unsafe condition arises, and should be capable of folding flat for storage when not needed.

Such floor signs are occasionally subjected to rough handling by service personnel, and may be knocked-about by mops, buckets, floor polishing and buffing machines and the like. The floor signs should be non-reactive to floor spills, cleaning solutions and wax solutions, and should be easily cleanable with detergent solutions that will not remove the display message. Desirably, the floor signs should be self-locking and stabilized in the spread-apart service configuration so that the signs can tolerate some rough handling without collapse and can be quickly returned to the upright display position after being knocked over.

Arrangements have been proposed for improving the hinge construction and the means for stabilizing the panels in the spread-apart configuration. For example, U.S. Pat. No. 4,253,260 discloses a self-standing floor sign including two panels that are hinged together by integrally formed hinge portions that mate in a rotary coupling and permit the panels to fold together while limiting spread-apart movement. A flexible strap also limits spread-apart movement, but the hinge panels are not otherwise stabilized against collapse.

U.S. Pat. No. 4,999,937 discloses a free-standing floor sign including a ratchet hinge that releasably locks the panels in a predetermined spread-apart position.

U.S. Pat. No. 4,974,815 discloses a free-standing floor sign including a hinge with a threaded metal hinge bolt that is tightened to compress the hinge portions together in a predetermined, spread-apart position, which is maintained by frictional engagement.

U.S. Pat. No. 5,009,541 discloses a free-standing, plastic barricade in which the panel portions include integrally formed hinge portions that are coupled together, with opening or unfolding movement of the panels being limited by metal bolts.

U.S. Pat. No. 4,928,415 discloses a foldable floor sign in which one of the panels includes integrally formed tab portions that are foldable and attachable to the other panel, thereby stabilizing the panels in a spread-apart configuration.

U.S. Pat. Des. 371,807 discloses a free-standing floor sign including front and rear display panels that are stabilized in a spread-apart configuration by triangular insert panel portions that extend between and are interlocked with the sloping display panel members.

These conventional self-standing floor signs have not been entirely satisfactory for various reasons, including the complexity of the integrally-formed hinge members; the lack of a stabilizing side panel that limits inward as well as outward folding movement; the presence of metal fasteners that are subject to corrosion in some of the arrangements; and only limited capability to display messages on the left side and right side as well as on the front and rear panels.

For these reasons, there is a continuing interest in improving the hinge construction and stabilizer construction for free-standing floor signs.

BRIEF SUMMARY OF THE INVENTION

The limitations discussed above are overcome according to the present invention by a free-standing, foldable floor sign including front and rear display panels that are coupled together for pivotal movement by integrally formed male and female hinge projections. The male and female hinge projections snap together into interlocking engagement with each other in response to axial compression. The male coupling member includes a resilient finger portion and a latching head, and the female coupling member includes a cylindrical collar having a latch pocket and a radially stepped, inwardly projecting retainer. The resilient finger portion is radially deflectable in response to sliding engagement of the latching head against the retainer to permit the latching head to clear the retainer and enter the latch pocket. The latching head is disposed in overlapping engagement with the retainer to oppose withdrawal of the latch out of the latch pocket when the male and female hinge projections are in the operative position.

In the preferred embodiment, the male and female hinge projections include first and second handle portions that are rotatable with respect to each other during opening and closing movement of the display panels. The handle portions abut each other when the display panels are spread apart in an operative service position, thereby opposing spreading movement of the panel members away from the operative service position. A locking arm is coupled to the panel members for movement to a position of interlocking engagement with the panel members in which the locking arm opposes movement of the panel members away from the operative service position. End portions of the locking arm are pivotally coupled to the panel members to permit rotation of the locking arm relative to the display panels during opening and closing movement, so that the locking arm extends transversely with respect to the display panels in the operative service position, and extends substantially in alignment with the display panels in the retracted position.

BRIEF DESCRIPTION OF THE DRAWINGS

The operational features and advantages of the present invention will be understood by those skilled in the art upon reading the detailed description which follows with reference to the attached drawings, wherein:

FIG. 6 is a front elevational view, partly broken away, of a display panel and its hinge coupling;

FIG. 7 is a left side elevational view thereof;

FIG. 8 is a right side elevational view thereof;

FIG. 9 is a top plan view thereof;

FIG. 10 is a sectional view of the handle hinge coupling assembly taken along the line 10—10 of FIG. 3;

DETAILED DESCRIPTION OF THE INVENTION

Figure 1:
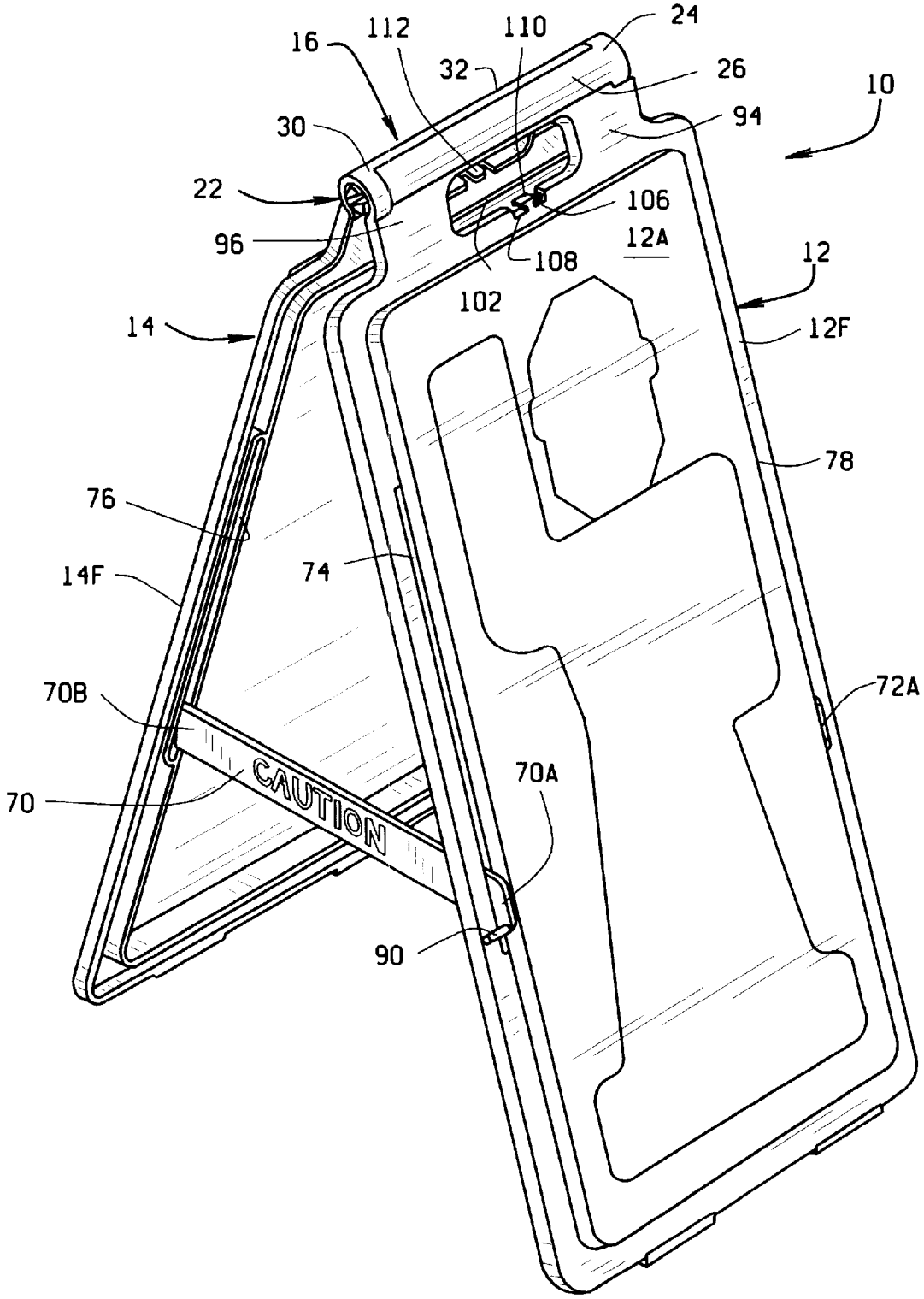
FIG. 1 is a front perspective view of the floor sign of the present invention in a free-standing, operative service configuration.

In the description which follows, like parts are indicated throughout the specification and drawings with the same reference numerals, respectively. The figures are not necessarily drawn to scale and the proportions of certain parts have been exaggerated for sake of clarity.

Figure 2:
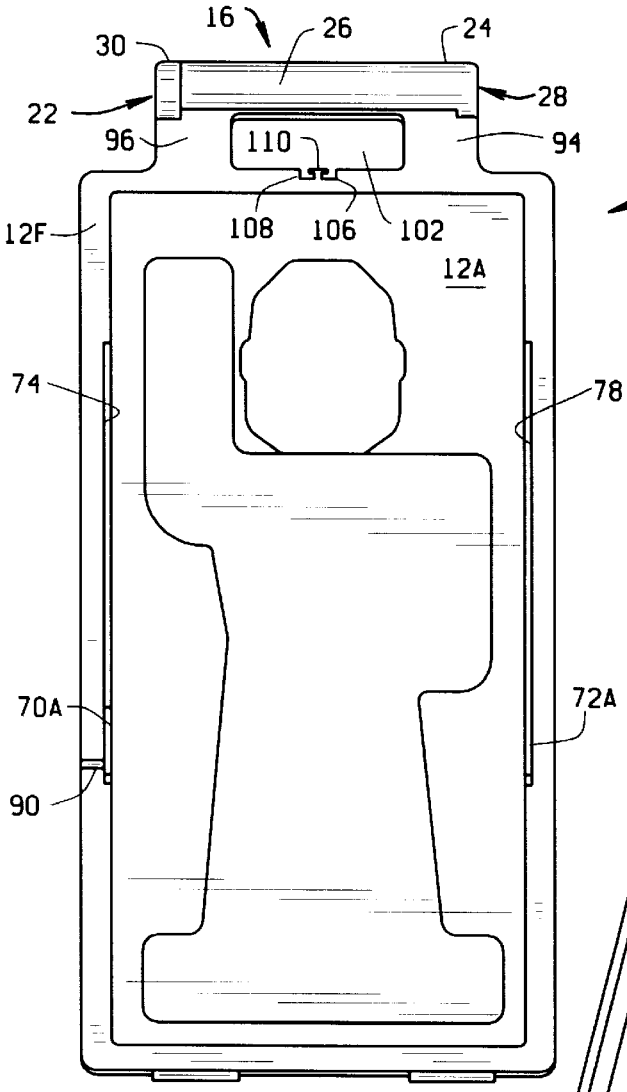
FIG. 2 is a front elevational view thereof.
Figure 3:
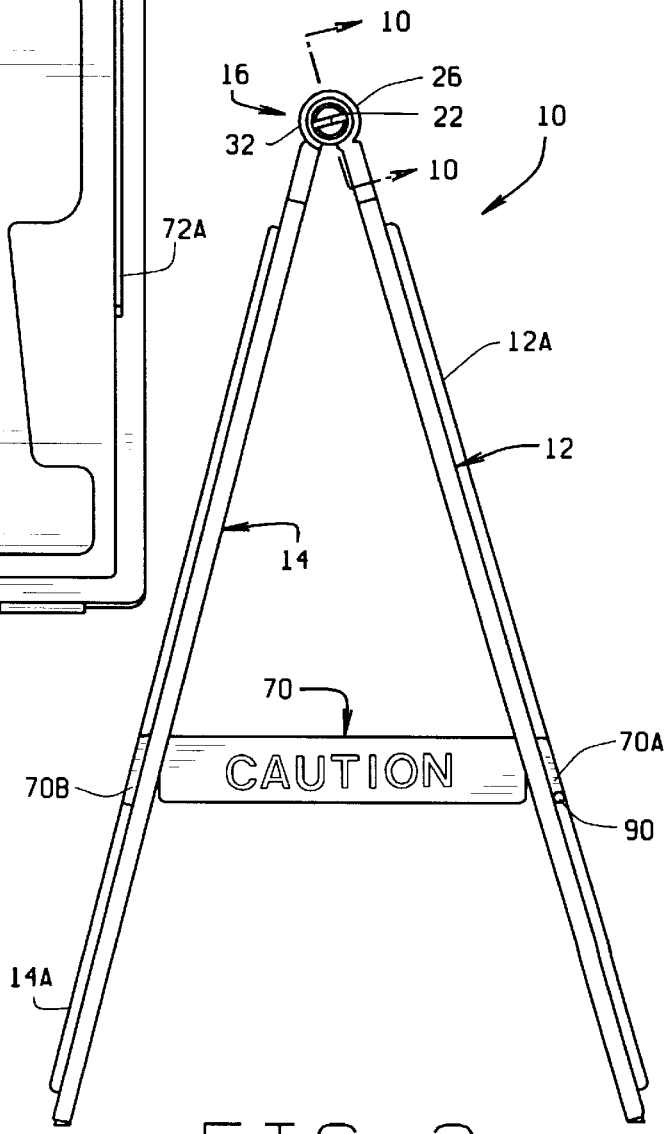
FIG. 3 is a left side elevational view thereof.
Figure 4:
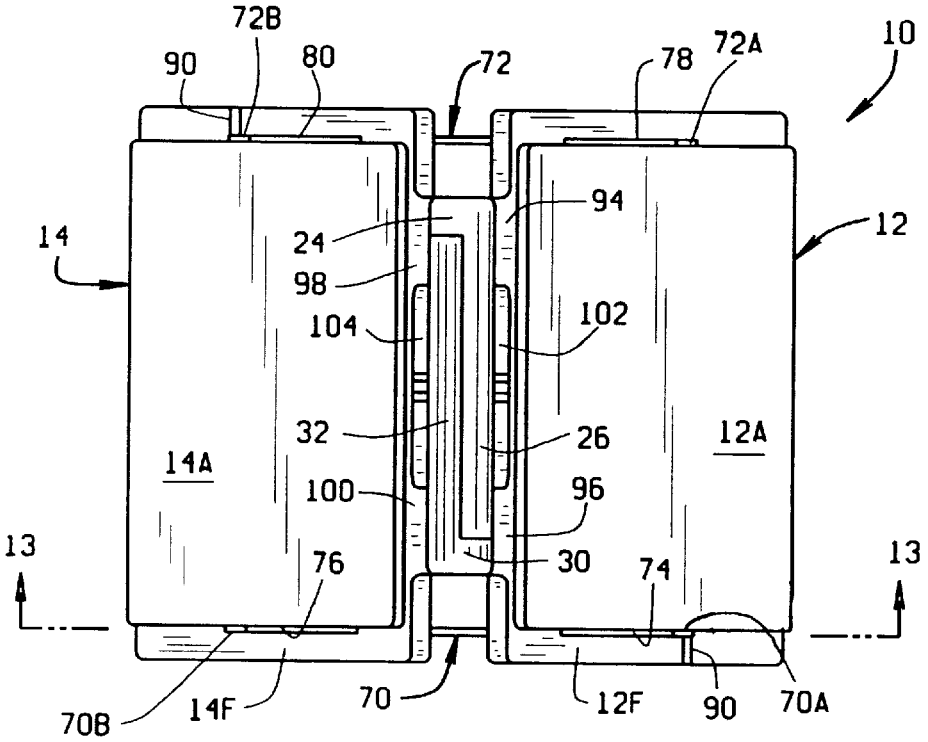
FIG. 4 is a top plan view thereof.
Figure 5:
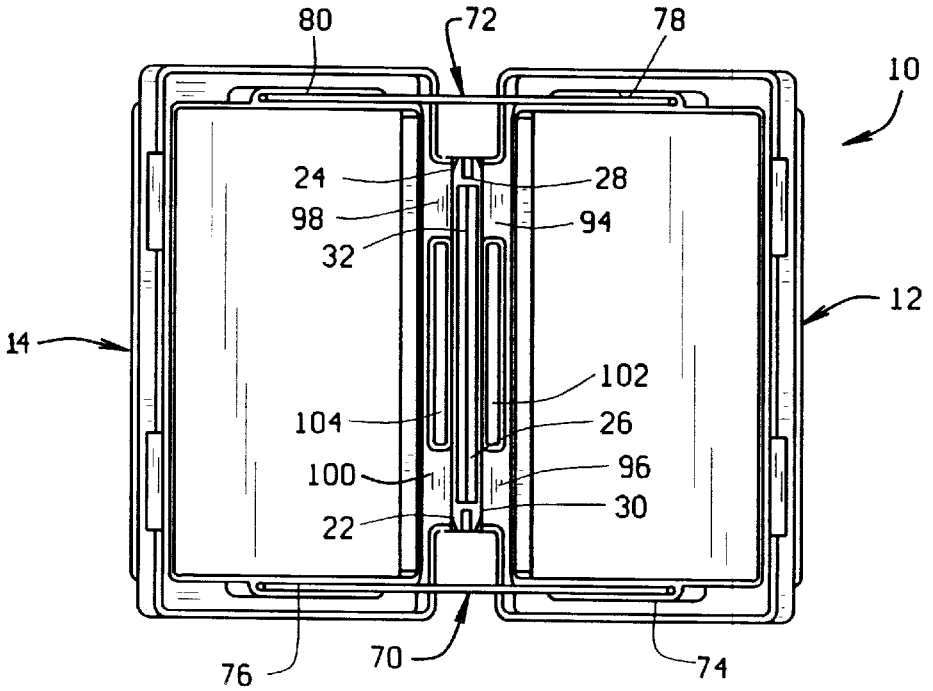
FIG. 5 is a bottom plan view thereof.
Figure 11:
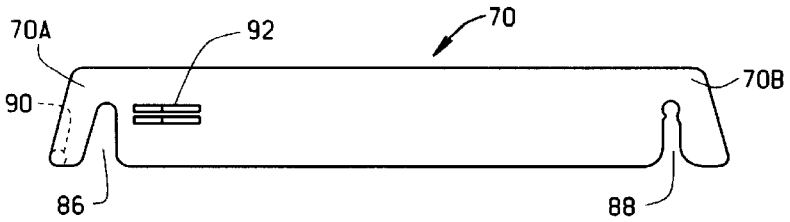
FIG. 11 is a rear elevational view of a locking arm.

Referring to FIG. 1, FIG. 2 and FIG. 3, a free-standing, foldable floor sign 10 includes a front display panel 12 and a rear display panel 14 that are coupled together for opening and closing movement relative to each other by a hinge assembly 16. The front and rear panel members 12, 14 are provided with flat embossed display panel surfaces 12A, 14A, respectively. Each display panel is substantially rectangular, and is formed of a moldable resin material such as polyethylene with a nominal wall thickness of 0.120 inch.

Referring now to FIGS. 6–10, the hinge assembly 16 includes hinge projections 18, 20 that are integrally formed with the display panels 12, 14, respectively. The hinge projection 18 includes a male coupling member 22, a female coupling member 24 and a handle portion 26. The male and female coupling members 22, 24 are formed on opposite ends of the handle portion 26. Likewise, the hinge projection 20 includes a male coupling member 28 and a female coupling member 30 formed on opposite ends of a complementary handle portion 32.

The male and female coupling members of the respective hinge projections 16, 18 are axially movable in sliding engagement with each other to an operative position, as shown in FIG. 10, in which the handle portions 26, 32 are aligned with each other and the male and female coupling members 22, 30 and 24, 28 are disposed in interlocking mating engagement with each other on opposite ends of the aligned handle portions.

Referring again to FIG. 9 and FIG. 10, the female coupling member 24 is in the form of a cylindrical collar having a cylindrical sidewall 34 enclosing a latch pocket 36. The inside entrance to the latch pocket 36 is restricted by a radially stepped, inwardly projecting annular retainer shoulder or ring 38 which defines a deflection passage 40 opening into the latch pocket 36.

The female coupling member 30, integrally formed on the complementary handle portion 32, is identical in construction with the female coupling member 24. In this mirror image arrangement, the female coupling member 30 is in the form of a cylindrical collar including a cylindrical sidewall portion 42 having a bore defining a latch pocket 44 and including a radially stepped, inwardly projecting annular retainer shoulder or ring 46. The bore of the retainer 46 defines a deflection passage 49 that is aligned axially with the deflection passage 40.

Referring again to FIG. 9 and FIG. 10, each coupling member comprises at least one resilient finger portion and a radially projecting latching head. In the preferred embodiment, the male coupling member 22 includes first and second latch heads 48, 50 and resilient finger portions 52, 54, respectively. The finger portions 52, 54 are integrally formed with and project axially from a common base member 56.

Preferably, the common base member 56 is integrally formed with the semi-cylindrical handle portion 26. The latch heads 48, 50 have sloping faces 48A, 50A that are dimensioned for insertion through the deflection passage 49. Each latch head includes a radially projecting latch portion 48B, 50B, respectively. The resilient finger portions are radially deflectable in response to sliding engagement of the latch portions 48B, 50B against the annular retainer shoulder 46 as the latching head is inserted into the latch pocket during axial sliding movement to the operative position. In the fully inserted, interlocked position, as shown in FIG. 10, the radially projecting latch head portions 48B, 50B are disposed in overlapping engagement with the annular retainer shoulder 46 to oppose withdrawal of the male coupling member 22 out of the latch pocket.

The male coupling member 28 has identical, mirror image construction with the male coupling member 22. According to this arrangement, the male coupling member 28 is integrally formed with the semi-cylindrical handle portion 32, and includes latch heads 58, 60 that are integrally formed with resilient fingers 62, 64, respectively. The resilient fingers are integrally formed with a common base portion 66 which, in turn, is integrally formed with the semi-cylindrical handle portion 32. The latch head portions 58, 60 likewise have sloping head portions 58A, 60A that are dimensioned for insertion into the deflection passage 40.

The complementary male and female hinge projections 22, 30 and 28, 24 snap together in interlocking engagement with each other in response to simultaneous axial compression of the male and female coupling members against each other. Initially, the male coupling member 22 of the front panel member 12 is inserted into the latch collar 30 of the rear display panel. At the same time, the male coupling member 28 of the rear display panel 14 is inserted into the latch collar 24 of the front display panel member 12.

The hinge projections are then compressed axially and squeezed together, thus causing the resilient fingers 52, 54 to deflect and permit the latch heads 48, 50 to pass through the deflection passage 49 simultaneously as the resilient fingers 62, 64 are deflecting and permitting the latch heads 58, 60 to pass through the deflection passage 40 on the opposite end of the hinge. The complementary hinge portions thus snap together, thereby defining a rotary coupling union which resists separation as a result of the overlapping engagement between the radially projecting latch head portions with the annular retainer shoulders.

Referring now to FIG. 3, FIG. 4, FIG. 5, FIG. 11, FIG. 12 and FIG. 13, the front and rear display panels 12, 14 are stabilized in the spread-apart service position (FIG. 1) by first and second locking arms 70, 72. The locking arms are pivotally coupled to the display panels on laterally opposite sides for folding movement within pairs of longitudinal slots 74, 76 and 78, 80, respectively, formed along opposite side edges of the front and rear display panels, respectively.

The locking arms 70, 72 include end portions 70A, 70B and 72A, 72B that project through the aligned slots 74, 76 and 78, 80, respectively. As shown in FIG. 1, FIG. 3, FIG. 5 and FIG. 13, the locking arms 70, 72 are latched in a position of interlocking engagement with the front and rear panel members in which the locking arms oppose movement of the panel members away from the operative service position. End portions of the locking arms are pivotally coupled to the panel members to permit rotation of the locking arms relative to the display panels during opening and closing movement.

Figure 13:
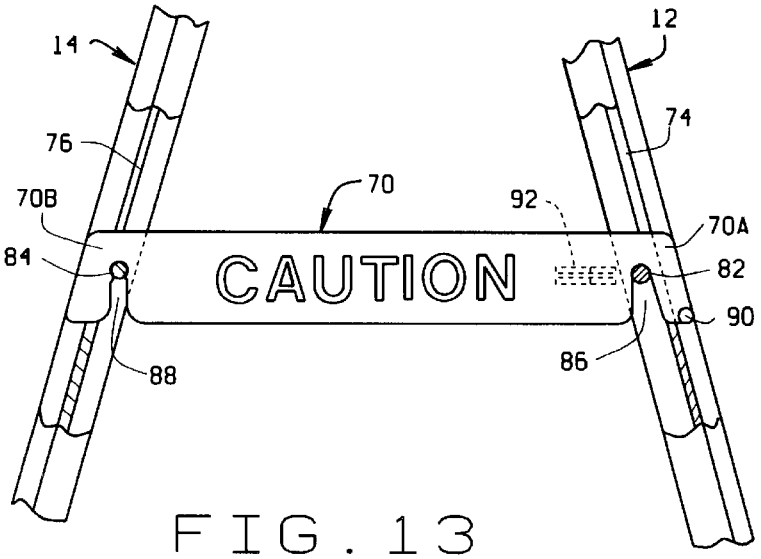
FIG. 13 is a side elevational view, partly broken away and partly in section, taken along the line 13—13 of FIG. 4 which illustrates latching engagement of the locking arm with the front and rear display panels.
Figure 14:
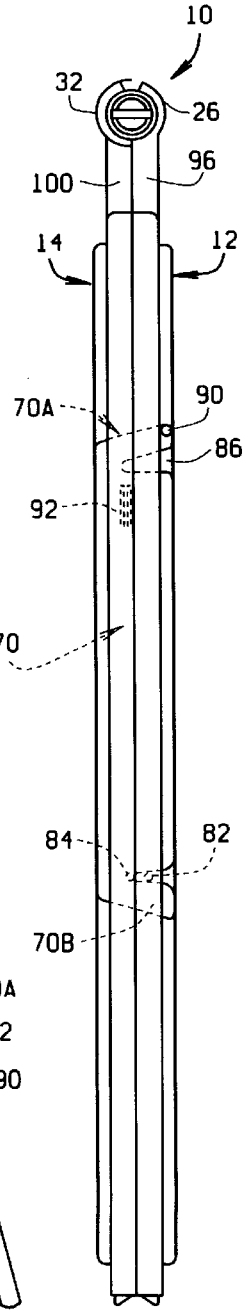
FIG. 14 is a side elevational view of the floor sign of FIG. 1 shown with the front and rear display panels and left side and right side locking arms folded together for storage or shipping.

Referring now to FIG. 13 and FIG. 14, latch pins 82, 84 are mounted within the longitudinal slots 74, 76, respectively, and a corresponding set of latch pins (not illustrated) are secured transversely across the slots 78, 80 on the opposite sides of the display panels 12, 14, respectively. Each locking arm is intersected by notches 86, 88 that are sized appropriately for receiving and engaging the latch pins 82, 84, respectively. According to this arrangement, the locking arm 70 is mounted on the latch pin 84 for pivoting movement and rotation relative to the rear display panel 14.

The opposite end of the locking bar 70 is free to travel through the slot 74 as the front panel member opens and closes relative to the rear panel member. However, the latch pin 82 in the slot of the front panel member stops downward movement of the locking arm 70 when the locking arm is substantially in a horizontal orientation and the front and rear display panels are spread-apart in the operative service position as shown in FIG. 1 and FIG. 3. The locking arms 70, 72 thus stabilizes the front and rear display panels against any further movement away from the desired operative service position.

Figure 12:
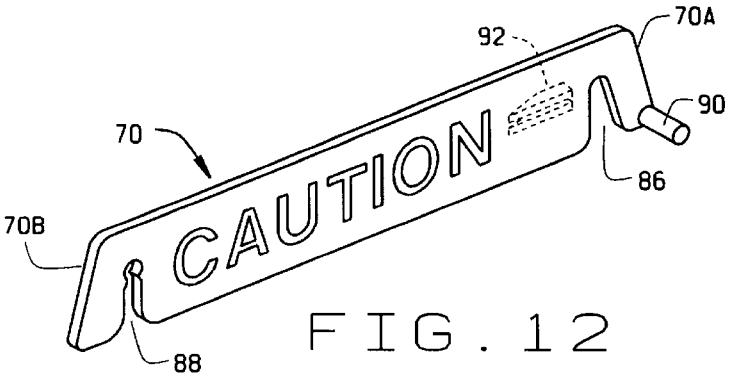
FIG. 12 is a front perspective view thereof.

According to one aspect of the invention, the locking arm 70 is captured within the slots 74, 76 so that it cannot be separated from the floor sign and lost or misplaced when not in use. This is made possible by a stop bar 90 that is attached to the forward end of the locking arm 70 as shown in FIG. 12 and FIG. 13. Additionally, a raised shoulder 92 is formed on the opposite side of the locking arm 70 which is engagable with the inside surface of the front display panel in response to closing movement of the front display panel relative to the rear display panel.

According to this arrangement, the locking arm 70 pivots counterclockwise about the latch pin 84, while the raised shoulder 92 slides against the inside surface of the front display panel as it closes inwardly, thus causing the locking arm 70 to lift away from the forward latch pin 82 and rotate in counterclockwise movement. At the same time, the stop bar 90 rides along the marginal front face of the front panel member from the lower end of the slot 74 to the upper end of the slot 74, as shown in FIG. 14. In the fully retracted position shown in FIG. 14, the front and rear panel members are folded together and the locking arm 72 extends substantially in flush alignment with the folded panel members.

Referring again to FIG. 14, the floor sign 10 is shown in its fully retracted, closed position in which it assumes a minimum profile for easy handling and stacking. Note that no portion of the locking arm 70 projects above or below the rectangular perimeter of the floor sign 10, thus permitting the floor signs to be stacked uniformly for storage, packaging and shipment. Moreover, the locking arm 70 is captured and retained within the slots 74, 76 by the latch pin 84 and the stop bar 90. According to this arrangement, the locking arm cannot separate inadvertently from the floor sign during handling and transportation.

Referring to FIG. 1, FIG. 2 and FIG. 6, the display panels 12A, 12B are integrally formed with and bordered by rectangular frame portions 12F, 14F, respectively. The handle portions 26, 32 are integrally formed with the frame portions 12F, 14F, respectively, and as shown in FIG. 1 and FIG. 2, the handle portion 26 is joined to the frame 12F by integrally formed connecting arms 94, 96. Likewise, the handle portion 32 is joined to the rear panel 14 by integrally formed connecting arms 98, 100.

The connecting arms 94, 96 are laterally spaced with respect to each other and support the handle portion 26 in longitudinally spaced relation to the panel member 12, thereby defining a hand opening 102. An identical hand opening 104 is formed between the rear frame 14F and the handle portion 32. The hand openings 102, 104 are aligned with each other, thus providing a convenient hand opening on both sides of the floor sign 10. The hand openings expose the underneath sides of the mating handle portions 26, 32, thereby providing a convenient hand grip.

Figure 15:
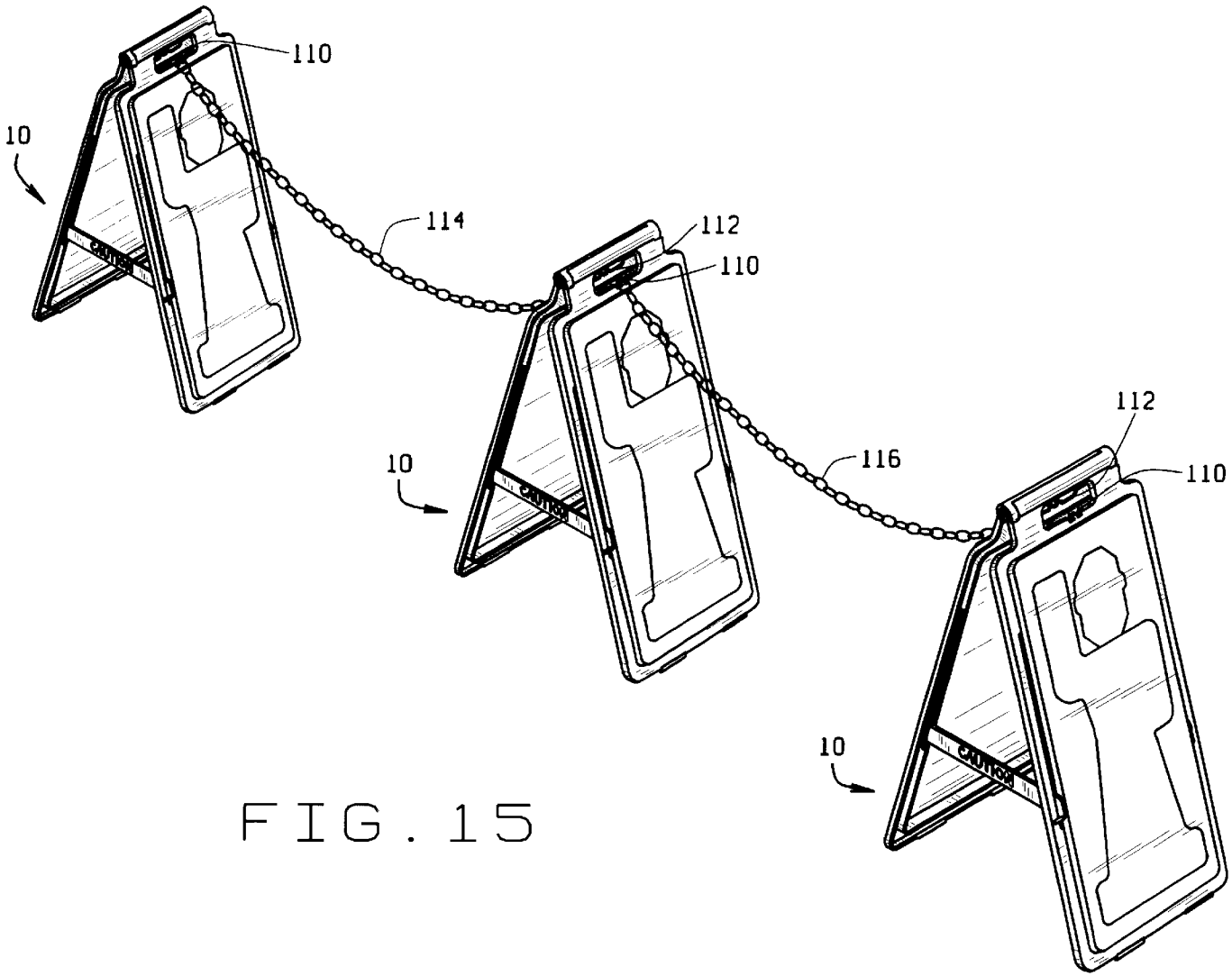
FIG. 15 is a perspective view of three identical floor signs that are linked together by chains for providing a wide area barrier to entry.

Referring now to FIG. 1, FIG. 6 and FIG. 15, the frame portions 12F, 14F are intersected by laterally spaced notch openings 106, 108, thereby defining a lug or hook 110, 112, respectively, on the frame portions 12F, 14F. As shown in FIG. 15, three floor signs are linked together with a pair of chains 114, 116, thereby providing a wide area barrier for discouraging unauthorized entry into an area where maintenance or repair operations are being performed. Preferably, the chains 114, 116 are constructed of lightweight plastic material such as nylon, with the end links of each chain being engaged and retained by the hooks 110, 112, respectively.

It will be appreciated that the floor sign 10 is of a size, weight and construction that permits it to be handled easily by one person, during initial set-up either alone or in a chain-linked wide area configuration. Moreover, with the exception of optional linking chains, the floor signs are completely self-contained and can be set-up and retracted without the use of tools.

What is claimed is:

1. A floor sign including front and rear display panels, a hinge coupling the display panels together for opening and closing movement relative to each other, each display panel being intersected by a slot extending lengthwise along one side edge, and a locking arm having first and second end portions disposed within the slots of said front and rear display panels, respectively, said locking arm being movably coupled to the display panels for rotation to a free-standing service position in which the locking arm extends transversely with respect to the display panels, and to a retracted position in which the display panels are folded together and the locking arm extends substantially in alignment with at least one display panel.

2. A floor sign as set forth in claim 1, including:

first and second latch pins disposed in the first and second lengthwise slots, respectively; and, the locking arm being intersected by first and second notches formed on the first and second end portions, wherein the first and second latch pins are received within the first and second notches, respectively, when the display panels and locking arm are disposed in the service position.

3. A floor sign as set forth in claim 1, the locking arm including a stop bar attached to one end of the locking arm and projecting transversely with respect to said locking arm, the stop bar being engagable with one of the display panels for limiting closing rotation of the stop bar relative to the display panels in the retracted position.

4. A floor sign as set forth in claim 1, including:

a shoulder formed on the locking arm, the shoulder being disposed for slidable engagement against one of the display panels as the locking arm and the display panels rotate to the retracted position.

5. A free-standing, foldable floor sign comprising front and rear display panels, each display panel including male and female hinge projections integrally formed thereon, the male and female hinge projections on the front display panel being disposed in interlocking engagement with the male and female hinge projections on the rear display panel, and including a handle portion disposed between the male and female hinge projections in each display panel, the handle portions being rotatable with respect to each other during opening and closing movement of the display panels and the handle portions abutting each other when the display panels are spread apart in a free-standing operative service position, thereby opposing opening movement of the display panels beyond the operative service position, and including a locking arm coupled to the display panels for movement to a position of interlocking engagement with the display panels in which the locking arm opposes opening and closing movement of the display panels away from the operative service position.

6. A floor sign as set forth in claim 5, the front and rear display panels being intersected by first and second slots, respectively, extending lengthwise along one side edge of said display panels, the locking arm including first and second end portions disposed within the first and second slots, respectively, the end portions being pivotally coupled to the display panels to permit rotation of the locking arm relative to the display panels during opening and closing movement of the display panels.

7. A floor sign as set forth in claim 6, including:

a first latch pin and a second latch pin disposed i n the first and second longitudinal slots, respectively; and, the locking arm being intersected by first and second notches formed on the first and second end portions, respectively, the first and second latch pins being disposed in the first and second notches, respectively, when the display panels and locking arm are disposed in the position of interlocking engagement.

8. A floor sign as set forth in claim 5, the locking arm including a stop bar attached to one end of the locking arm and projecting transversely with respect to said end of the locking arm, the stop bar being engagable with one of the display panels for limiting rotation of the locking arm relative to the display panels when the display panels are in a retracted position.

9. A floor sign as set forth in claim 5, the male and female hinge projections being axially movable in sliding engagement with each other to an operative position in which the handle portions are aligned with each other and the male and female hinge projections on one display panel are disposed in interlocking mating engagement with the male and female hinge projections of the other display panel, respectively.

10. A floor sign as set forth in claim 5, wherein:

each female hinge projection comprises a cylindrical collar including a sidewall portion defining a latch pocket and a radially stepped, inwardly projecting shoulder portion; and, each male hinge projection comprises at least one resilient finger portion and a radially projecting latching head, the resilient finger portion being radially deflectable in response to sliding engagement of the latching head against the shoulder portion as the latching head is inserted into the latch pocket during axial movement to the operative position.

11. A floor sign as set forth in claim 5, wherein:

each female hinge projection comprises a coupling collar having a latch pocket and a retainer ring having a bore opening into the latch pocket; and, each male hinge projection comprising first and second resilient head portions that are adapted for radial deflection in response to sliding engagement of the head portions against the retainer ring as the male coupling member is inserted through the retainer ring bore into the latch pocket.

12. A floor sign as set forth in claim 5, wherein:

each female hinge projection comprises a cylindrical collar including a cylindrical sidewall integrally formed with the handle portion, said cylindrical sidewall having an axial bore defining a latch pocket, and including a radially stepped retainer shoulder defining a deflection passage disposed between the handle portion and the latch pocket; and, each male hinge projection comprising an axially projecting latch integrally formed with the handle portion, the latch being radially deflectable relative to the retainer shoulder in response to sliding engagement of the latch against the retainer shoulder as the latch is inserted through the deflection passage into the latch pocket, and the latch being disposed in overlapping engagement with the retainer shoulder to oppose withdrawal of the latch out of the latch pocket when the male and female hinge projections are in the operative position.

13. A floor sign as set forth in claim 5, wherein each handle portion comprises a semi-cylindrical sidewall, and the male and female hinge projections are integrally formed with the semi-cylindrical sidewall.

14. A floor sign comprising first and second display panels pivotally connected to one another for movement between a closed position and an operative service position, at least one of said display panels having a slot extending along a portion thereof, and a movable locking arm for maintaining said panels in the operative service position, said locking arm having a stop to prevent withdrawal of said locking arm from said slot, at least a portion of said locking arm being received within said slot when said first and second display panels are moved into the closed position.

15. The floor sign of claim 14, wherein said locking arm is pivotally connected to the display panel having said slot.

16. The floor sign of claim 15, wherein said locking arm includes a notch by which it is pivotally connected to the display panel having said slot.

17. The floor sign of claim 15, wherein said display panels each include a slot extending along a portion thereof, and said locking arm is received within said slots when said first and second display panels are moved into the closed position.

18. The floor sign of claim 17, wherein said locking arm includes a first end portion extending through the first display panel slot and a second end portion extending through the second display panel slot when said display panels arc in the operative service position.

19. The floor sign of claim 17, wherein said locking arm includes a first end and a second end, said display panels each include a latch pin extending through at least a portion of said slot, and said locking arm includes a notch on each of said first and second ends for pivotally engaging said latch pins.

20. The floor sign of claim 19, further comprising a second locking arm.

* * * * *